United States Patent [19]

Willard

[11] Patent Number: 4,594,782

[45] Date of Patent: Jun. 17, 1986

[54] BILLIARD CUE TIP SHAPER, SCUFFER, TRIMMER AND GAUGE

[76] Inventor: James A. Willard, 2213 Jericho Rd., Aurora, Ill. 60506

[21] Appl. No.: 764,213

[22] Filed: Aug. 9, 1985

[51] Int. Cl.[4] ..... B27L 9/00

[52] U.S. Cl. ..... 30/494; 30/462

[58] Field of Search ..... 30/494, 462

[56] References Cited

U.S. PATENT DOCUMENTS

| | | | |
|---|---|---|---|
| 284,548 | 9/1883 | Gwyn | 30/494 |
| 574,374 | 1/1897 | Balsley | 30/462 |
| 1,259,136 | 3/1918 | Rogers | 30/494 |
| 1,534,975 | 4/1925 | Lindfors | 30/494 |
| 2,577,995 | 12/1951 | Bozarth . | |
| 3,989,079 | 11/1976 | Treadway | 30/494 |

FOREIGN PATENT DOCUMENTS

| | | | |
|---|---|---|---|
| 23534 | 7/1921 | France | 30/494 |

OTHER PUBLICATIONS

A billard cue tip shaper, scuffer and gauge without the trimming lugs was sold by applicant more than one year prior to this application—date unknown.

*Primary Examiner*—Frederick R. Schmidt
*Assistant Examiner*—J. T. Zatarga

[57] ABSTRACT

A cue tip shaper, scuffer, and gauge with a built-in edge trimmer. The device has a carbide lined depression and outwardly extending lugs, also carbide covered. Relative rotation between the device and a cue tip shapes the tip, scuffs it to accept chalk and trims any material extending beyond the circumference of the stick. A gauge for the tip is provided in an edge of the device.

4 Claims, 7 Drawing Figures

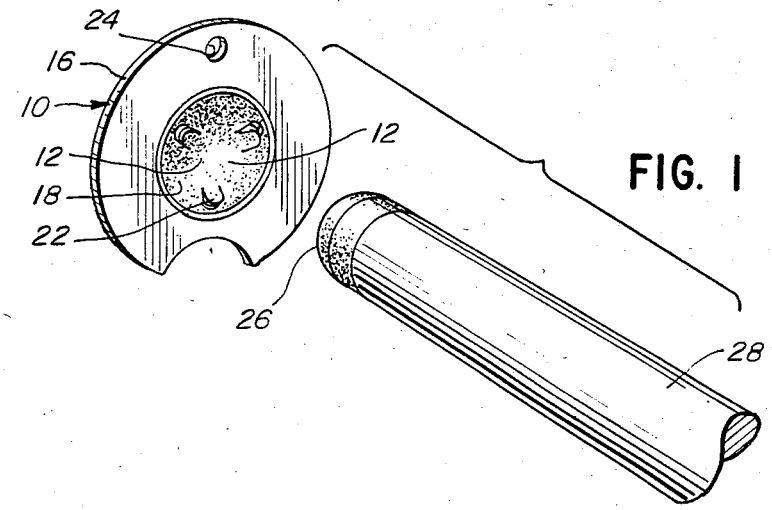
FIG. 1
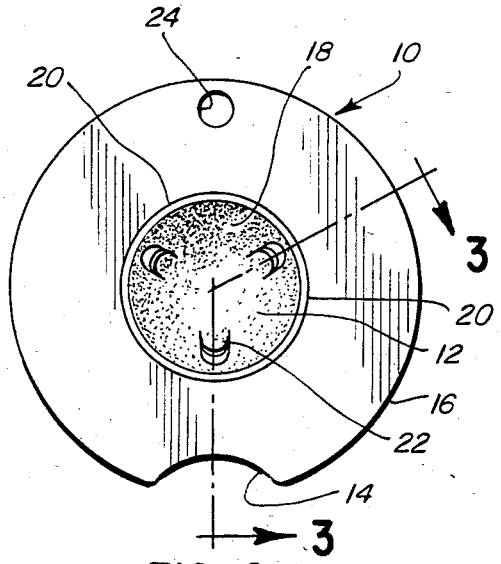
FIG. 2
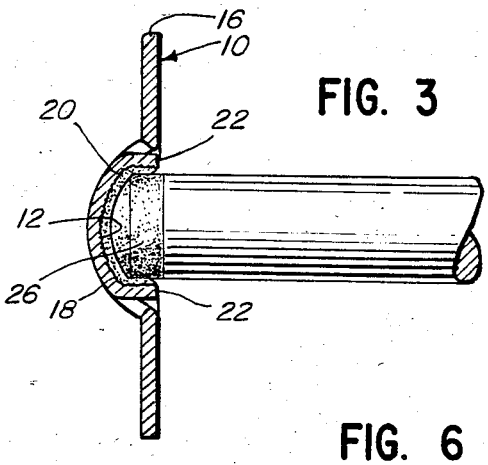
FIG. 3
FIG. 6
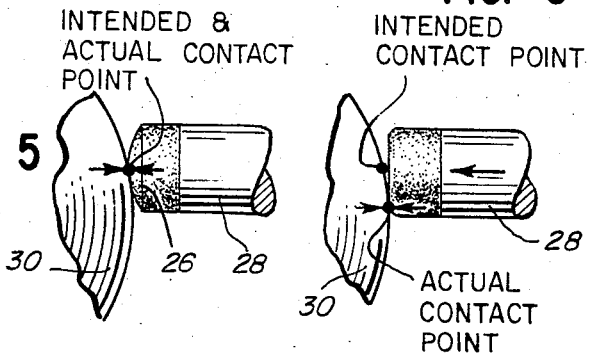
FIG. 5
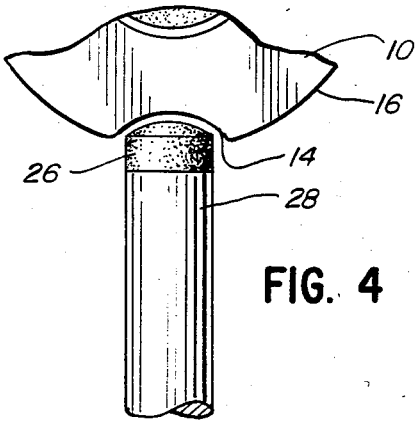
FIG. 4
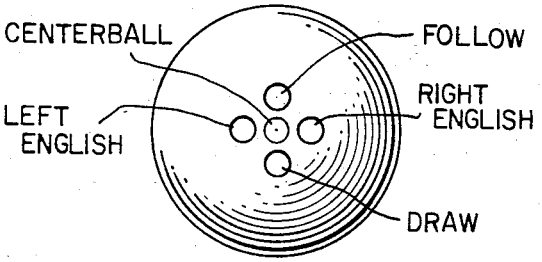
FIG. 7

BILLIARD CUE TIP SHAPER, SCUFFER, TRIMMER AND GAUGE

BACKGROUND OF THE INVENTION

It is well known by billiard players that the curvature or convexity of the tip of the cue stick is a matter of considerable importance. Every time the cue strikes a ball, the shape of the tip is slightly altered, and long use will flatten the tip centrally, causing the edges to project beyond the body of the cue. The best players of the game are the most carefull to secure a uniform curvature for the tip of the cue stick and they attempt to preserve that curvature.

FIELD OF INVENTION

This invention relates to a device for shaping, scuffing, trimming and gauging the tip of a billiard cue stick.

DESCRIPTION OF PRIOR ART

Gwyn, U.S. Pat. No. 284,548 of Sept. 4, 1883, discloses a billiard cue trimmer consisting of "a block composed of wood, metal, composition or other material provided with a series of chambers, each having a concave bottom covered with sand-paper or emery cloth, the curvature of each concave bottom being graduated throughout the series in accordance with a fixed standard, and the scale of curvature being indicated by any appropriate symbol, whereby a cue tip may be trimmed to any convexity desired by a player".

In use, the end of the cue is placed in one of the chambers, the cue is revolved in the block or the block revolved upon the cue. The sand-paper or other abrading material quickly trims the tip to the desired degree of convexity, providing a true curvature at every point, besides imparting a fresh, clean surface which takes chalk readily.

Treadway, U.S. Pat. No. 3,989,079 of Nov. 2, 1976, discloses a lightweight pocket size cue dresser for shaping the tip of a cue stick to the various shapes and styles desired by individual poolplayers. The dressing surface is generally parabolic in shape, the surface being covered by an abrasive.

The device is used substantially in the same manner as the device of the earlier patent to Gwyn.

Bozarth, U.S. Pat. No. 2,577,995 of Dec. 11, 1951, discloses a device for trimming the leather tips of billiard cue sticks. A blade is used to remove any excess leather extending beyond the circumference of the cue shaft.

SUMMARY OF THE INVENTION

According to the present invention, an improved cue tip shaper, scuffer, trimmer and gauge is provided in a single, small, pocketable device which can readily carried on a key chain.

The device of this invention has a metal body with a generally spherical or concave depression, the radius of which can be that of a United States coin, i.e., a nickel—0.415 inch, or a dime—0.358 inch, which are the desired radii for the tips of cue sticks. The depression is lined with an abrasive, for example a silicon carbide grit, for long life. The abrasive is preferably brazed onto the metal body of the device. A portion of the device functions as an edge trimmer and comprises at least two spaced and generally parallel tabs or lugs projecting from the base of the depression and facing outwardly therefrom. These lugs are also coated with the abrasive, at least on their inwardly facing surfaces. The edge trimmer removes excess tip material which extends beyond the circumference of the cue stick.

The edge of the device is provided with a generally circular cut-out or indent which has the same curvature as the concave depression and serves as a gauge, so that a player can determine whether or not the tip of the cue stick is correctly shaped.

BRIEF DESCRIPTION OF THE DRAWING

FIG. 1 is a perspective view of the cue tip shaper, scuffer, trimmer and gauge of this invention and a cue stick after the tip is shaped, scuffed and trimmed;

FIG. 2 is a plan view of the cue tip shaper, scuffer, trimmer and gauge of this invention;

FIG. 3 is a cross-sectional view taken on line 3—3 of FIG. 1 showing the tip of a cue stick being trimmed;

FIG. 4 is a partial plan view showing the tip of a cue stick being gauged;

FIG. 5 is a view of the desired shape of a cue tip and its contact point with a billiard ball;

FIG. 6 is a view of the shape of a cue tip before using this invention showing its contact point with a billiard ball; and FIG. 7 is a illustration of a billiard ball showing the locations for hitting with the cue stick for various well known billiard shots.

DETAILED DESCRIPTION OF THE PREFERRED EMBODIMENT

As shown in FIGS. 1, 2 and 3, the cue tip shaper, scuffer, trimmer and gauge of this invention, identified as 10, comprises a generally circular plate-like metal device, having a centrally positioned, concave depression 12, and a circular cut-out 14 at its defining edge 16. The depression 12 is covered with a silicon carbide grit layer 18, the carbide being brazed or otherwise bonded thereto. Extending from the wall 20 of the depression 12 are three tab-like members or lugs 22, generally equally spaced from and generally parallel to each other and the circumference of the depression. These lugs also have the carbide grit bonded thereto on their inwardly facing surfaces. an opening 24 is provided by which the device can be attached to a key chain.

In use, the tip 26 of a cue stick 28 is placed in the depression and either the stick or the device 10 is rotated relative to the other. The abrasive material shapes the tip to the proper curvature, scuffing it at the same time, so that not only is the tip properly shaped, but is provided with a fresh surface which takes chalk readily. Excess tip material which extends beyond the edge of the cue stick is removed when the tip 26 of the cue stick 28 is rotated in engagement with at least two of the lugs 22. The tip 26 can then be gauged at the circular cut-out 14.

The desired contact point of the cue tip 26 and a billiard ball 30 is shown in FIG. 5; it being desirable to hit the ball at the center of the tip 26, so as to control its path. This is possible when the tip 26 is properly shaped, as by using the device of this invention. Ball control is lost when the tip is misshapped, as illustrated in FIG. 6. Here the intended contact point 32 is displaced from the actual contact point 34, which is struck by an edge of the generally flat, misshaped tip, the actual contact point not being at the center of the tip.

Billiard players aim at the billiard ball at various places for the various shots, know by expert billiard players as "centerball", "follow", "draw", Left English" and "Right English". The locations on a billiard ball for cue tip contact for these shots are illustrated in FIG. 7 and are identified on the drawing by suitable legends.

The particular shape of the device 10 is a design feature; the device can be made in many other shapes if desired, so long as the features described are incorporated therein.

The appended claims are intended to be construed as broadly as the prior art will permit.

I claim:

1. A cue tip shaper, scuffer and trimmer comprising:

a metal member having a generally concave depression therein;

an abrading material covering the bottom of the depression; and a plurality of spaced tabs or lugs extending outwardly from the depression and arranged in a single, generally circular array, each of said tabs or lugs being covered by said abrading material at least on their inwardly facing surfaces;

whereby the face of a cue stick when rotated in said depression is shaped and scuffed and any portion thereof extending beyond the circumference thereof is trimmed by said tabs or lugs.

2. A cue tip shaper, scuffer and trimmer as recited in claim 1, wherein said abrading material is a silicon carbide grit bonded to said member and said member is generally circular in shape.

3. A cue tip shaper, scuffer and trimmer, as recited in claim 1, wherein said abrading material is a silicon carbide grit bonded to said member, and further comprising a generally circular cut-out portion at the edge of said member to gauge the contour of said tip, the shape of said cut-out portion generally matching the shape of said depression.

4. A cue tip shaper, scuffer, trimmer and gauge comprising:

a metal member having a generally concave depression therein and means defining a generally circular cut-out at its edge having generally the same curvature as the depression;

a plurality of spaced lugs having surfaces generally parallel to one another extending outwardly from said depression and arranged in a single generally circular array, the diameter of which is substantially that of said cue tip; and an abrasive grit material bonded to the bottom of said depression and at least to the inwardly facing surfaces of said lugs;

whereby a cue stick rotated in engagement with said abrasive in said depression and with at least two of said plurality of lugs is shaped, scuffed, and trimmed of excess material extending beyond the edge thereof, and is thereafter gauged in said cut-out.

* * * * *